United States Patent [19]

McLaughlin et al.

[11] 4,267,915

[45] May 19, 1981

[54] VENDING APPARATUS PRICE INTERFACE

[75] Inventors: Donald L. McLaughlin, Newtown Square; Paul J. Beshenich, Norristown, both of Pa.

[73] Assignee: Mars, Inc., Mc Lean, Va.

[21] Appl. No.: 948,170

[22] Filed: Oct. 3, 1978

[51] Int. Cl.[3] ..... G07F 9/00

[52] U.S. Cl. ..... 194/1 N; 194/2; 194/DIG. 3

[58] Field of Search ..... 194/1 R, 1 L, 1 M, 1 N, 194/2, 10, DIG. 3

[56] References Cited

U.S. PATENT DOCUMENTS 4,008,792 2/1977 Levasseur et al. ..... 194/1 N 4,143,749 3/1979 Otten ..... 194/DIG. 3

*Primary Examiner*—Joseph J. Rolla

*Attorney, Agent, or Firm*—Davis, Hoxie, Faithfull & Hapgood

[57] ABSTRACT

A price interface for use in connecting a calculating and control unit with a multiprice vending apparatus, the price interface including a first register for storing the initial price value during a vending cycle and a second register for storing the current price value during the vending cycle.

13 Claims, 4 Drawing Figures

VENDING APPARATUS PRICE INTERFACE

We have invented an improved interface for coupling a multiprice vending apparatus or the like with a credit accumulating and transaction approval apparatus. Our invention has particular utility when used in coupling coin testing mechanisms with vending machines and will be described primarily in that context.

Most commerical vending systems include two major interconnected elements: the vending apparatus and the calculating apparatus. The vending apparatus includes product selection devices (such as electrical switches) which are actuated by the user, and product delivery or vending means. The calculating apparatus determines the validity of coins or other credits deposited by the user, accumulates the credit value of acceptable coins, compares the credit value with the price of the selected product, and authorizes or refuses vending of the selected product by the vending apparatus.

There are two basic classes of vending systems: single price and multiprice. In recent years the trend has been toward more sophisticated, multiprice systems. Such systems, however, are more susceptible to accidental or intentional activation in a manner which will cause the system to return coins, or product, or a combination of coins and product having a value greater than that of the coins deposited. The present invention is intended to reduce the likelihood of such occurrences.

It is necessary in a multiprice vending system to communicate the price of the user selected product from the vending apparatus where the selection is made to the calculating apparatus where the comparison can be made of the price value with the credit value deposited by the user, and a determination can be made whether or not to authorize vending. If vending is authorized by the calculating apparatus, this information must be communicated back to the vending apparatus to actuate vending of the selected product.

In the past, most multiprice vending systems employed a more or less brute force approach to conveying the price of the selected product to the calculating apparatus. A common technique required a technician to make electrical connections from each of the selection switches for products of the same price to a resistor connected to a power source. This was repeated for each price of product in the vending apparatus. When one of the selection switches in this type of multiprice vending apparatus was actuated, current was drawn through a selection switch and thus through the resistor, producing a signal indicative of the price of the product selected. This signal then actuated a circuit, such as price matrix, to provide price information to the calculating apparatus in digital form. Often isolation means, such as transformers or optical couplers, were required in the interface circuits associated with each price.

Recently, vending apparatus has been made which incorporates a price matrix associated with each selection switch. A price data bus of several lines is employed to transmit the price of the selected product to the calculating apparatus in parallel, binary digital form, in substantially the same way that data buses are employed in some computer systems.

The price interface of the present invention provides means for connecting the price data bus of modern vending apparatus with a calculating apparatus.

Figure 1:
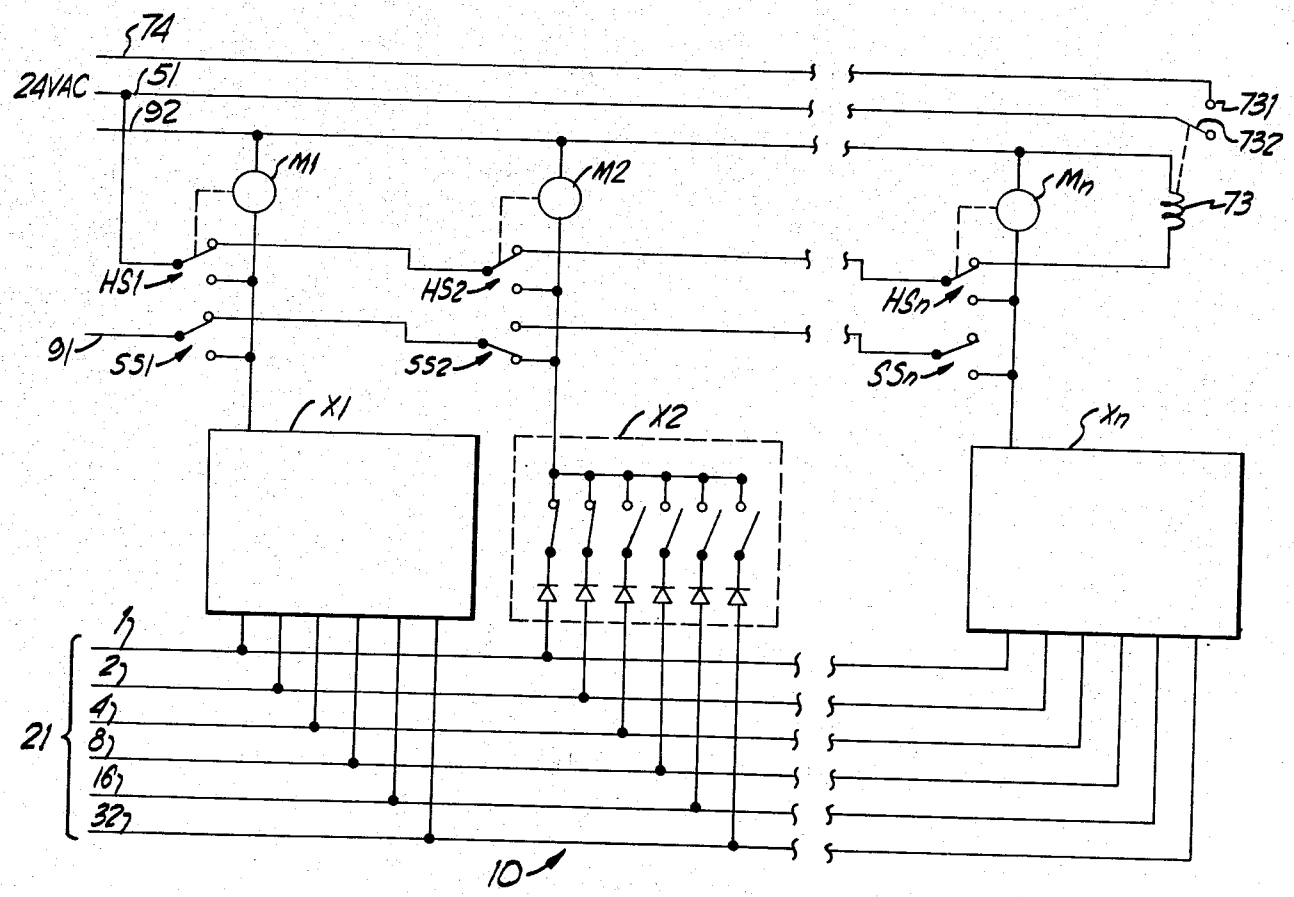
FIG. 1 is a schematic block diagram of a multiprice vending apparatus including a price data bus.

Although price interface apparatus constructed in accordance with the principles of this invention may be designed to operate with price information denominated in the currency of any country, the invention will be adequately illustrated by explanation of its application to apparatus utilizing U.S. currency.

It will be clear to those skilled in the art, that, whereas the invention has been described in some places in terms of NAND and NOR logic elements, alternative logical elements may be used without departing from the invention. Similarly, the word "signal" has been used to represent an electrical indication without limitation to a relatively high or low output voltage of a device producing such signals.

Suitable components and component values for an embodiment of the present invention are indicated in the drawings and the specification. Where not othewise indicated, all diodes in this embodiment are type 1N4148, all amplifiers are RCA invertors COS/MOS type CD4049B, and all Schmidt trigger circuits (indicated by the letter "S" in the drawings) are RCA type CD40106B.

The multiprice vending apparatus 10 in FIG. 1 is equipped to transmit price selection information in binary form on six price data lines 1, 2, 4, 8, 16 and 32, which comprise the price data bus 21. The vending apparatus comprises a plurality of vending actuators or motors Ml through Mn. One electrical connection to the winding of each motor Ml–Mn is connected in common by wire 92 to one side of the power source, such as the neutral side of a 24VAC power source. The other side of each motor Ml–Mn is connected to a momentary contact selection switch SSl–SSn, a holding switch HSl–HSn, and a price matrix Xl–Xn. The selection switches SSl–SSn are wired together in conventional fashion so that power can be applied by a selection switch to only one motor Ml–Mn from the vend drive wire 91 at a time. The holding switches HSl–HSN are similarly wired so that power can be applied to only one motor Ml–Mn at a time from the "hot" side of a power source, such as the 24VAC wire 51. The vending apparatus also includes a relay 73, activated by current flowing from the 24VAC source wire 51 through the contacts of the unactuated holding switches HSl–HSn in series. When one of the holding switches HSl–HSn is activated by the starting of its corresponding motor Ml–Mn, the relay 73 is deactivated causing its contacts 731 and 732 to open. This disconnects the vend in process signal wire from the 24VAC source wire 51. The resulting signal (absence of 24VAC) is transmitted as the vend in process signal to the price interface 15.

For the purpose of this discussion, we will assume that selection switch SS2 has just been actuated by a user. The same principles of course apply if another of the selection switches is actuated. Similarly, if a selection switch other than selection switch SS2 is actuated, the circuitry associated with selection switch SS2 functions in the same fashion as the circuitry associated with other non-selected selection switches.

When selection switch SS2 is closed, the vend drive wire 91 is connected to both the corresponding motor M2 and the corresponding price matrix X2. This permits external control circuitry (such as the price interface 15 and calculating apparatus 20 discussed below in connection with FIGS. 2 through 4) to both receive price data from the pricing matrix X2 and activate the motor M2 with AC power on the vend drive wire 91. Once the external control circuitry has determined the price from the pricing matrix X2 and decided that the transaction shall proceed, the motor M2 is activated with AC power transmitted via vend drive wire 91 and selection switch SS2. The user, however, only momentarily activates the selection switch SS2, therefore, the holding switch HS2 is activated by the motor M2 once it starts, to apply power directly from the 24VAC wire 51 to the motor M2 until the completion of a vending cycle, at which time the holding switch HS2 automatically opens in the conventional manner, turning the motor M2 off. The series connection of the holding switches HSl–HSn also serves to release the relay 73 during the period when a motor is operating.

When a selection switch, such as switch SS2, is closed by the user, the appropriate price data wires 1, 2, 4, 8, 16, 32 comprising the price data bus 21 are connected to the vend drive wire 91 through the price matrix X2 which corresponds to the switch SS2. A small current is then drawn from the 24VAC power source via a resistor or group of resistors 95 (providing a resistance of approximately 15 ohms) shunting the output of the vend switch 90 in the price interface 15, then via the vend drive wire 91, the price matrix X2, the price data bus 21, and a relatively high resistance to neutral (ground) in the input buffer 25 of the price interface 15. The current which can be drawn through resistor 95 is insufficient to activate the motor M2. Such use of a small signalling current is well known in the vending machine art.

The price matrices Xl–Xn are of conventional design, as shown, for example, by price matrix X2. Switches or other means are provided for selectively coupling one or more of the data wires 1, 2, 4, 8, 16 and 32 of the data bus 21 to the selection switch SS2 corresponding to the price matrix X2. In the example shown, where the price data bus 21 conveys price information in binary form and the increments are valued at 5-cents, a product selected by operation of selection switch SS2 is priced at 15-cents. The signal on price data wires 1 and 2 (binary equivalent of 3, times 5-cents equals 15-cents) are connected by the price matrix X2, via the select switch SS2, to the vend drive wire 91. For a one dollar purchase, price data wires 16 and 4 (binary equivalent of 20, times 5-cents equals one dollar) would be connected by a price matrix to the vend drive wire 91.

Figure 2:
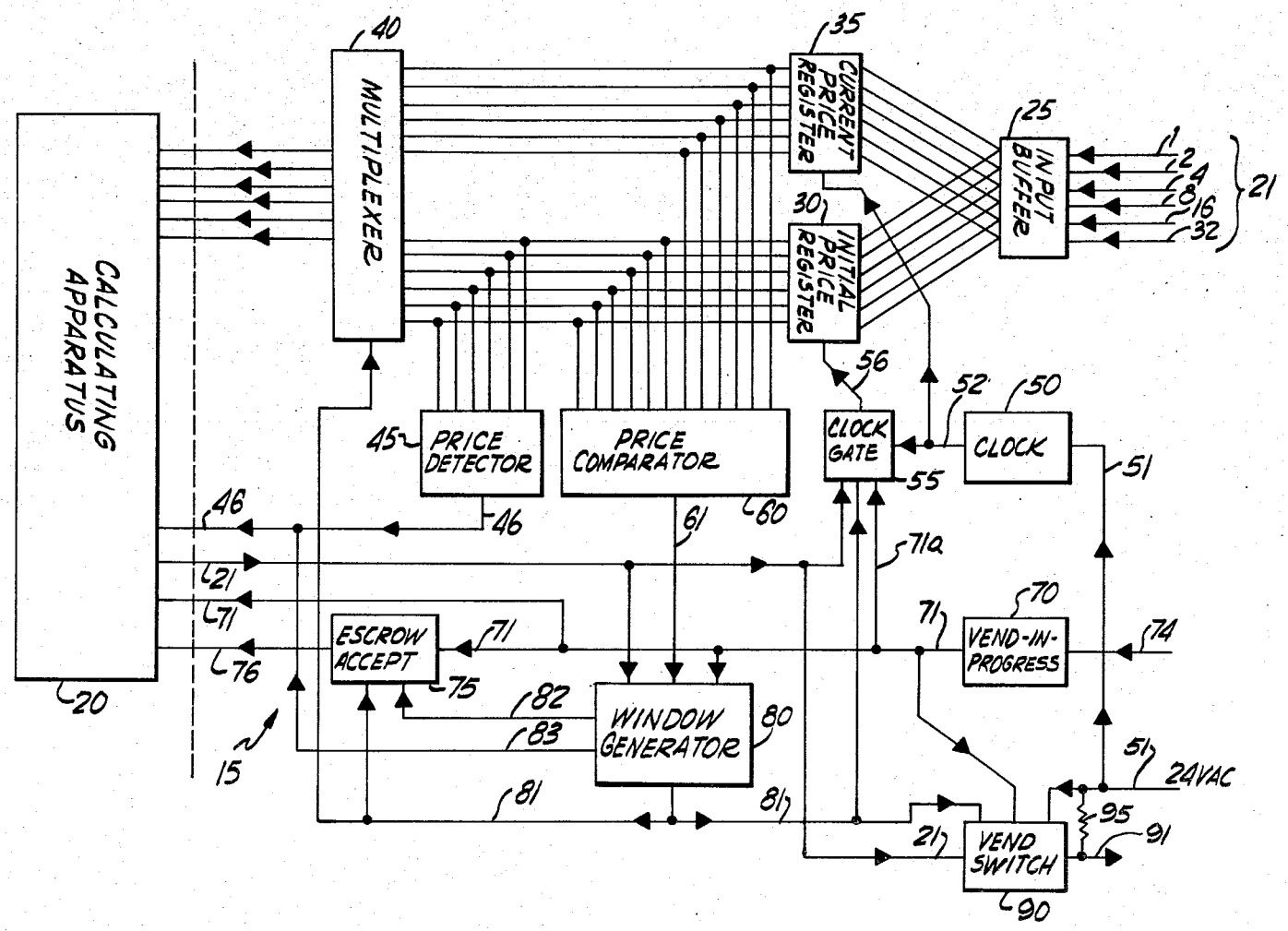
FIG. 2 is a schematic block diagram of an interface circuit for connecting the multiprice vending apparatus of FIG. 1 with a calculating apparatus.

FIG. 2 is a block diagram functionally depicting a price interface circuit 15 in accordance with the present invention. Price information concerning the product selected by the user is received from the vending apparatus 10 on the price data bus 21 and received by an input buffer circuit 25. The information from the price data bus 21 is then transmitted to both an initial price register 30 and a current price register 35, each comprising six flip-flops for storing the information from the price data bus 21 in parallel.

In some cases, the user of a vending machine may accidentally or intentionally attempt to change selections during a vend cycle. As their names suggest, the initial price register 30 stores the price of the goods selected at the beginning of the vend cycle. The current price register 35 stores the price of the most recent selection. Initially both registers 30 and 35 contain the same price information. In the event of an attempt to change selections, the initial price register 30 will retain the price of the original selection and the current price register 35 will store the price of the current selection.

A clock 50 is provided to produce a narrow pulse centered within the negative half cycle of the alternating current power source provided by wire 51. This pulse is used to trigger registers 30 and 35 in conventional fashion, causing them to read and store the price information from the data bus 21 via the input buffer 25.

Price detector circuit 45 is activated when one or more of the outputs of one of the price registers, in this case the initial price register 30, indicates that data has been stored. After a short delay, typically 30 milliseconds, the price detector circuit 45 transmits a single vend request pulse on wire 46. This delay of the period of a few clock pulses avoids activation by data generated by transients or garbled data which may occur when a selection switch is first activated. The vend request pulse on wire 46 is transmitted to the calculating apparatus 20 to initiate comparison of the price of the selected product with the credit accorded the user, for example, as a result of coins deposited in a coin mechanism. If, as a result of the comparison, the calculating apparatus 20 authorizes vending, a vend authorization signal from the calculating section 20 is produced on wire 21. It is used (1) to activate a vend switch 90, such as a triac switch circuit, (2) to activate clock gate 55 thereby cutting off the flow of clock pulses on wire 56 to the initial price register 30 and freezing the initial price data in initial price register 30, and (3) to condition a logic circuit or window generator circuit 80. A suitable means for communicating vend request and vend authorization signals to and from a calculating unit is described in co-pending U.S. Ser. No. 843,286, filed Oct. 18, 1977, now U.S. Pat. No. 4,188,961.

The vend switch 90 applies power to the vend drive wire 91 by shorting out the register 95, thereby actuating the selected motor, motor M2 in this example, within the vending apparatus 10. As a result, the motor M2 actuates its holding switch HS2, causing the vend in progress relay 73 to deenergize. This opens contacts 731, 732 causing the vend in progress (blocker) signal (absence of 24VAC) to be transmitted on wire 74 from the vending apparatus 10 to the vend in progress buffer 70 in the price interface 15.

A price comparator 60 monitors the outputs of the two price registers 30 and 35. When the output of the current price register 35 differs from that of the initial price register 30, the price comparator 60 produces an output signal on wire 61.

The window generator 80 is a logic circuit which monitors the outputs of the price comparator 60, the vend authorization wire 21 and the vend in progress buffer 70. If (1) the prices stored in registers 30 and 35 are not the same, (2) the vend authorization signal on wire 21 has disappeared, as a result of the current price exceeding the user's credit, and (3) the vend in progress signal from the vend in progress buffer 70 has not occurred on wire 71, then the window generator 80 produces a window pulse, typically of 500 milliseconds duration, on wire 81. This window pulse permits the apparatus to take certain anti-fruad precautions.

In the absence of a window pulse, multiplexer 40 transmits the price information stored in the current price register 35 to the calculating apparatus 20. The window pulse on wire 81 switches the multiplexer 40 so that the initial price data stored in register 30 is transmitted to the calculating apparatus 20 instead of the current price data from register 35. The window pulse also blocks the operation of the escrow accept signal generator 75 (described below), preventing completion of the transaction, and maintains the actuation of clock gate 55 so that the price stored in initial price register 30 remains unchanged.

If the vend in progress signal on wire 71 is received by the window generator 80 during the period of the 500 millisecond window pulse, the window generator 80 generates an "artificial" vend request signal in the form of a 0.25 millisecond pulse on wire 83 which connects with vend request wire 46. This pulse instructs the calculating apparatus 20, which had switched out of the vend authorization state when the current price exceeded the user's credit, to return to the vend authorization state. The 0.25 millisecond pulse also initiates a 50 millisecond pulse from the window generator 80 on wire 82 which connects with the escrow accept signal generator 75. If the vend in progress signal is not received during the period of the window pulse, the vending cycle is aborted and the calculating apparatus will retain the user's credit and await another product selection.

The escrow accept signal generator 75 produces an escrow accept signal on wire 76 instructing the calculating section whether or not to deduct the price from the user's credit and return any required change. The escrow accept signal is produced under either of two circumstances: (1) the window pulse is not received and the vend in process signal is received on wire 71 (wire 712 in FIG. 4), or (2) the window pulse is received concurrently with the 50 millisecond pulse on wire 82, which indicates the receipt of the vend in process signal during the period of the window pulse.

It should be noted in connection with the foregoing discussion that when a motor M2 has rotated sufficiently to actuate the holding switch HS2, the motor will continue to operate until the end of the vend cycle. Once the holding switch HS2 has closed, the price data from the associated price matrix X2 will appear on the price data bus 21 for the remainder of the vend cycle. Another selection switch, for example switch SSl, could be actuated while a motor M2 is operating. The signal on the vend drive line 91 would transmit through the selection switch SS1, via the price matrix X1 and onto the price data bus 21. When more than one set of price data appears in this fashion on the price data bus, the effect is to logically "OR" the data. As a result, the effect of pressing a selection switch SS1 after the start of a vend cycle initiated by another selection switch SS2 can only increase the price value on the price data bus 21.

The calculating apparatus 20 is arranged to continue to monitor its price input and compare the price value with the user's credit until the completion of the vend cycle, as indicated by the escrow accept signal. This signal is derived from the vend in progress signal which always occurs after a holding switch HS2 is closed. By the time the vend in progress relay contacts 731, 732 open, the actuated vend motor M2 is committed to complete its vend cycle.

Provided the price value at the calculating apparatus 20 input remains equal to or less than the user's credit value, the calculating apparatus will permit vending to proceed and the price value for the vend actually occurring will be deducted from the user's credit and used to calculate the amount of change to be returned. In rare cases, the price charged may be more than the correct price for the product vended, due to the "OR" of two prices on the data line. This condition is the result of "multibutton" manipulation of the selection switches by the user.

The two registers of the present invention provide a means for dealing with the condition that occurs when the price data supplied to the calculating apparatus 20 changes after the vend cycle has begun and the new price exceeds the user's credit. The calculating apparatus will terminate the vend authorization signal, however, the vending motor may coast sufficiently to continue the vend. This condition may occur as the result of a quick actuation by the user of a higher price selection or the release of the selection switch SS2 just before the corresponding motor M2 has been able to actuate its holding switch HS2. As a result, without the present invention, it is possible that the vend would be completed and the user's full credit would be returned. In accordance with the present invention, the user receives only the appropriate change for the selection actually vended.

Figure 3:
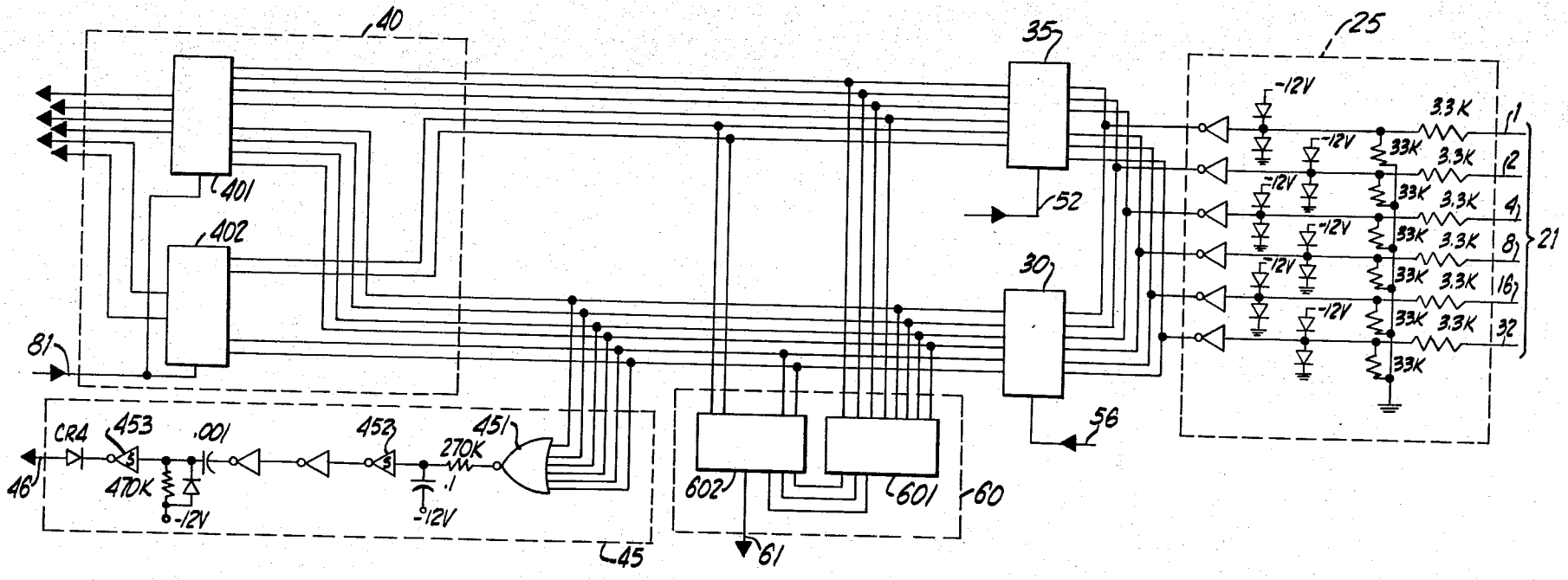
FIG. 3 is a schematic diagram of the parallel price data path through an embodiment of the interface circuit of FIG. 2.
Figure 4:
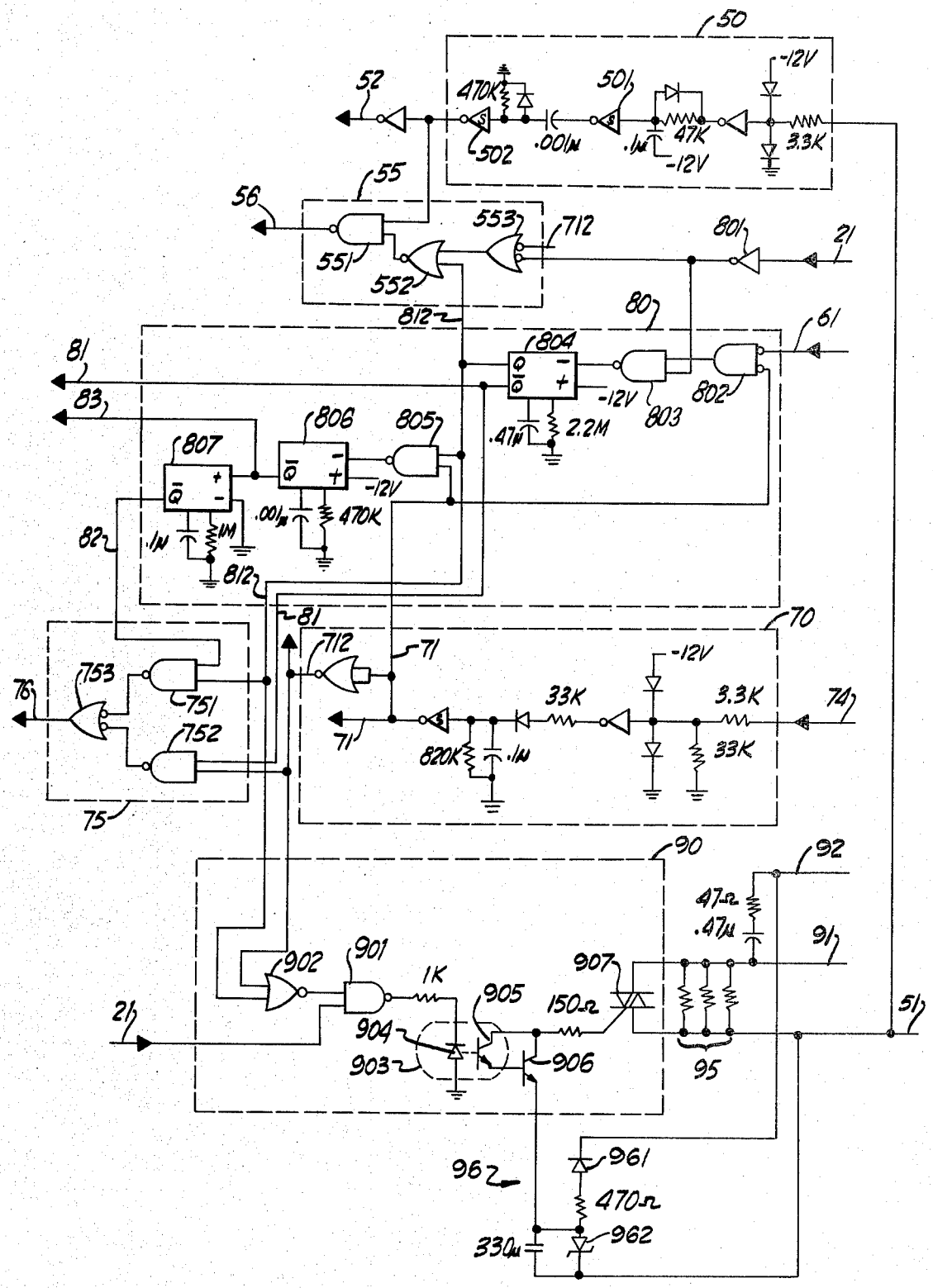
FIG. 4 is a schematic diagram of control circuits for the embodiment of FIG. 3.

Greater detail of an embodiment of our invention is shown in FIGS. 3 and 4. The blocks outlined by dashes in FIGS. 3 and 4 correspond to the blocks of FIG. 2 bearing the same numbers. The same numbers have also been employed where the wires correspond in the various figures.

The main parallel data path is shown in FIG. 3. The price data is received by the input buffer 25 from the vending apparatus on the price data bus 21 comprising wires 1, 2, 4, 8, 16 and 32. The resistors, and the diodes connected to ground and −12 V, establish the operating points for the inputs to the amplifiers for each data line. The amplified price data bus signals are then applied to the triggering input terminals of each of two groups of flip-flops (for example RCA COS/MOS type CD40174B) comprising the price registers 30 and 35. The clock inputs of the price registers 30 and 35 are connected to the clock gate 55 and clock 50 by wires 52 and 56 respectively. The clock gate 55 and the clock 50 are shown in detail in FIG. 4.

The price detector 45 has an input NOR gate 451 which monitors the output of the initial price register 30. If a signal appears on any of the inputs of the NOR gate 451, the Schmidt trigger circuit 452 provides a pulse which is amplified and AC coupled to another Schmidt trigger circuit 453, producing a signal at the output wire 46 of the price detector 45 indicative of a product selection having occurred and the price information having been captured in price register 30. Price comparator 60 comprises a group of six comparators in two packages 601 and 602 in this embodiment (for example, RCA COS/MOS type CD4063B), which produce an output signal on wire 61 indicating whether or not the outputs of the price registers 30 and 35 are the same.

The outputs of the price registers 30 and 35 are applied to the inputs of a two-line to one-line multiplexer 40 comprising, in this embodiment, two packages 401 and 402 of four multiplexer circuits each (for example, RCA COS/MOS type CD40257B). The multiplexer 40 functions as a electronically controlled switch in response to the window pulse on wire 81 from the window generator 80, shown in FIG. 4. Normally, the multiplexer 40 transmits the output of the current price register 35 to the calculating apparatus 20; however, as described above, in response to the window pulse, the multiplexer 40 disconnects the signals from the current price register 35 and transmits to the calculating apparatus 20 the signals representing the values stored in the initial price register 30.

FIG. 4 provides further detail concerning control circuitry suitable for the embodiment of FIG. 3 of the present invention. The operation of this circuitry will be clear to those skilled in the art from the schematic diagrams in the drawings and the functional descriptions here and above.

The clock circuit 50 employs two AC coupled Schmidt trigger circuits 501 and 502 to produce the narrow clock pulse which is synchronized with the alternating current power source used for operation of the vending system. One output of the clock 50 on wire 52 causes the current price register 35 to repeatedly sample and store the information on the price data bus 21. The other output of the clock 50 is connected to one input of a NAND gate 551, (for example, a RCA COS/-MOS type CD4011B) in the clock gate 55 which controls the flow of clock pulses to the initial price register 30. The other terminal of the NAND gate 551 is connected by two NOR gates 552 and 553 to receive controlling signals on wire 712 from the vend in progress circuit 70, on wire 81 from the window generator 80 and on wire 211 from the vend authorization signal inverter 801.

The vend in progress circuit 70 is a buffer for the vend in progress signal received on wire 74 from the vending apparatus 10 as a result of the opening of relay contacts 731 and 732. One output of the vend in progress circuit 70 is supplied on wire 711 to the window generator 80 and the calculating apparatus 20 to indicate a vend in progress status. The other output (inverted in this case) of the vend in progress circuit is supplied on wire 712 to the clock gate 50 and to the escrow accept signal generator circuit 75.

We turn now to the vend switch circuit 90. Assuming for the moment that the calculating apparatus 20 has approved vending as a result of the comparison of the signals received from the price interface 15 with the value credited to the user, the vend switch 90 provides the power necessary to actuate the selected motor Ml–Mn to dispense the selected product. The vend authorization signal on wire 21 from the calculating apparatus 20 is applied to one input of a NAND gate 901, in the vend drive circuit 90. The other input of the NAND gate 901 is connected to a NOR gate 902, which in turn is connected to receive (1) the window pulse via wire 81, and (2) the vend in progress signal via wire 712. As a result, either a vend in progress signal or a window generator pulse will disable the vend drive circuit 90 although the calculating apparatus 20 has authorized vending by a vend authorization signal on wire 21. The NAND gate 901 drives a light emitting diode 904 in an optical coupler 903, causing its associated photo-transistor 905 to drive transistor 906, thereby switching on the electronic vend switch, a triac 907. This connects 24VAC from wire 51 to the selection switch wire 91, so that the power can flow back through the actuated selection switch, in this example switch SS2, to start the motor M2 and initiate vending. Proper switching of the triac 907 is assured by returning the transistor 906 emitter to the gate bias network 96. In the gate bias network 96, of one embodiment of this invention, the diode 961 is a type IN4004 and the zener diode 962 is a 4.7 volt type IN4732. An arc suppression circuit comprising a 47 ohm resistor and a 0.47 microfarad capacitor is connected between the selection switch wire 91 and the power source neutral wire 92.

As noted above, the window generator 80 is a logic circuit which performs several functions to prevent the dispensing of change and product having a greater value than the user's credit. A prerequisite to the operation of the window generator 80 is a vend authorization signal from the calculating apparatus 20, which is received on wire 21 at the input to a Schmidt trigger circuit 801. This Schmidt trigger circuit 801 also provides an inverted vend authorization signal to the clock gate 55 via wire 211. A first NAND gate 802 produces a signal unless its inputs receive both a vend in progress signal on wire 711 and a signal on wire 61 from the price comparison circuit 60 indicating that the outputs of the price registers 30 and 35 are the same. The outputs of the first NAND gate 802 and the inverted vend authorization signal on wire 211 from the Schmidt trigger circuit 801 are applied to the input of a second NAND gate 803. This in turn drives the negative triggering input of a first monostable multivibrator 804, producing the 500 millisecond window pulse at its Q output and an inverted window pulse at its Q-NOT output. These are transmitted to and used by the clock gate 55, the escrow accept signal generator 75, and the vend drive circuit 90. The window pulse from the first monostable multivibrator 804 and the vend in progress signal on wire 71 are also applied to the inputs of a NAND gate 805. When these signals are concurrent, the NAND gate 805 triggers a second monostable multivibrator 806 producing a 0.25 millisecond pulse which is transmitted on wires 83 and 46 to the calculating apparatus 20 as an "artificial" vend request signal under the circumstances discussed in connection with FIG. 2 above. The second monostable multivibrator 806 also triggers a third monostable multivibrator 807. The latter multivibrator 807 then produces a 50 millisecond pulse which is transmitted to the escrow accept signal generator 75 via wire 82.

The escrow accept signal generator 75 comprises a pair of input NAND gates 751 and 752 and a NOR gate 753 connected to receive the NAND gate outputs.

We claim:

1. A price interface for use with a multiprice vending machine or the like and a vending machine control circuit in a vending system which comprises product selection means, means for producing a price selection signal having a price value corresponding to a selected product which price value may change during the system's vending cycle, means for comparison of a price value with the value of a vending system user's original credit, means for vending the selected product, and means for deducting a price value from the user's original credit, the price interface comprising a first register for capturing and storing a first price value which is the price value detected at the beginning of the vending cycle, means for comparing the first price value with a current price value detected later during the vending cycle, and means for determining whether the first price value or the current price value is representative of the product actually vended and transmitting that price value to the means for deducting a price value from the user's original credit.

2. The price interface according to claim 1 wherein each price selection signal is a binary parallel signal transmitted on price data lines.

3. The price interface according to claim 1 further comprising a price comparator for comparing the value stored in the first register with the value stored in the second register and interrupting the vend cycle when these values are not equal.

4. The price interface of claim 3 for use in a vending machine which provides a vend in progress signal when the vending machine has been actuated and vending is in process, further comprising a logic circuit for generating a pulse of predetermined duration when a signal is received concurrently from the control circuit and the price comparator, and window logic means for determining whether the vend in progress signal occurs during the period of the window pulse.

5. The price interface of claim 1 further comprising a second register for capturing and storing the current price value during a vending cycle.

6. The price interface according to claim 5 wherein each price selection signal is a binary parallel signal transmitted on price data lines.

7. The price interface of claim 1 wherein the vending machine has an AC power source which determines the frequency of the signals on the price data lines, the price interface further comprising clock circuit synchronized with the vending machine's AC power source for producing series of pulses, wherein said pulses activiate the second register to periodically accept the price value from the price data lines.

8. The price interface of claim 7 further comprising a clock gate connected between the output of the clock and the first register, wherein the clock gate interrupts the clock pulses after the first register has captured and stored the first price value in a vending cycle.

9. The price interface of claim 7 wherein the clock circuit produces a short pulse at the middle of a half cycle of current of the vending machine's AC power source.

10. The price interface of claim 9 further comprising a clock gate connected between the output of the clock and the first register, wherein the clock gate interrupts the clock pulses after the first register has captured and stored the first price value in a vending cycle.

11. The price interface of any of claims 1, 5 or 6 further comprising a price detector connected to the output of one of the registers, and which produces a price detected signal when said register's output indicates that it has captured the first price value in a vending cycle.

12. The price interface of claim 11 wherein the price detected signal is applied to the control circuit to activate comparison of a price value stored in a register with a machine user's credit and thereby determine whether or not to vend a product selected by the user.

13. The price interface of claim 12 wherein the vending machine has an AC power source further comprising delay means for delaying the price detected signal for at least one cycle of the AC power before it is applied to the control circuit.

* * * * *

UNITED STATES PATENT AND TRADEMARK OFFICE

CERTIFICATE OF CORRECTION

PATENT NO. : 4,267,915

DATED : May 19, 1981

INVENTOR(S) : Donald L. McLaughlin & Paul J. Beshenich

It is certified that error appears in the above-identified patent and that said Letters Patent are hereby corrected as shown below:

Col. 2, line 27, "othewise" should be --otherwise--.

Col. 3, line 49, "signal" should be --signals--.

Col. 4, line 43, "register 95" should be --resistor 95--.

Col. 4, line 68, "anti-fruad" should be --anti-fraud--.

Col. 5, line 39, "vend in process" should be --vend in progress--.

Col. 8, line 4, "IN4004" should be --1N4004--.

Col. 8, line 5, "IN4732" should be --1N4732--.

Col. 10, line 2, (Claim 7) "activiate" should be --activate--.

Col. 10, line 19, (Claim 11) "claims 1, 5 or 6" should be --claims 1-3 and 5-10--.

Signed and Sealed this

*Twentieth* Day of *October 1981*

[SEAL]

*Attest:*

GERALD J. MOSSINGHOFF

*Attesting Officer*

*Commissioner of Patents and Trademarks*